US009654881B2

(12) United States Patent
Ishii et al.

(10) Patent No.: US 9,654,881 B2
(45) Date of Patent: May 16, 2017

(54) ELECTROACOUSTIC TRANSDUCER

(71) Applicant: TAIYO YUDEN CO., LTD., Taito-ku, Tokyo (JP)

(72) Inventors: Shigeo Ishii, Takasaki (JP); Takashi Tomita, Takasaki (JP); Fumihisa Ito, Takasaki (JP); Yutaka Doshida, Takasaki (JP); Yoshiyuki Watanabe, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 14/935,372

(22) Filed: Nov. 6, 2015

(65) Prior Publication Data

US 2016/0157021 A1 Jun. 2, 2016

(30) Foreign Application Priority Data

Dec. 2, 2014 (JP) ..... 2014-243807
Mar. 27, 2015 (JP) ..... 2015-066539

(51) Int. Cl.
*H04R 25/00* (2006.01)
*H04R 17/00* (2006.01)
(Continued)

(52) U.S. Cl.
CPC ..... *H04R 17/00* (2013.01); *H04R 17/10* (2013.01); *H04R 31/003* (2013.01);
(Continued)

(58) Field of Classification Search
CPC ..... H04R 1/1075; H04R 1/22; H04R 1/24; H04R 1/26; H04R 5/033; H04R 7/04;
(Continued)

(56) References Cited

U.S. PATENT DOCUMENTS 4,330,729 A * 5/1982 Byrne ..... H04R 17/10 310/322
4,418,248 A * 11/1983 Mathis ..... H04R 1/26 381/190

(Continued)

FOREIGN PATENT DOCUMENTS

JP 2013150305 A 8/2013

OTHER PUBLICATIONS

Non-Final Office Action issued by U.S. Patent and Trademark Office, dated Jul. 28, 2016, for co-pending U.S. Appl. No. 14/887,214.
U.S. Appl. No. 14/930,528, Electroacoustic Transducer, Nov. 2, 2015.
U.S. Appl. No. 14/887,214, Electroacoustic Transducer, Oct. 19, 2015.

(Continued)

*Primary Examiner* — Huyen D Le
(74) *Attorney, Agent, or Firm* — Law Office of Katsuhiro Arai

(57) ABSTRACT

An electroacoustic transducer has a housing, piezoelectric speaker, dynamic speaker, and support member. The piezoelectric speaker includes a vibration plate having a first surface and a second surface on the opposite side of the first surface, as well as a piezoelectric element joined to at least one of the first surface and second surface, and divides the interior of the housing into a first space facing the first surface and a second space facing the second surface. The dynamic speaker is placed in the first space. The support member is constituted by a part of the housing or by a member different from the housing, has a supporting part facing the first surface or second surface, and supports the periphery of the first surface or second surface with the supporting part.

17 Claims, 11 Drawing Sheets

(51) Int. Cl.

| | |
|---|---|
| ***H04R 17/10*** | (2006.01) |
| ***H04R 31/00*** | (2006.01) |
| *H04R 1/10* | (2006.01) |
| *H04R 1/24* | (2006.01) |
| *H04R 1/28* | (2006.01) |
| *H04R 5/033* | (2006.01) |
| *H04R 7/20* | (2006.01) |

(52) U.S. Cl.
CPC ..... *H04R 1/1075* (2013.01); *H04R 1/24* (2013.01); *H04R 1/2842* (2013.01); *H04R 5/033* (2013.01); *H04R 7/20* (2013.01); *H04R 31/006* (2013.01); *H04R 2205/022* (2013.01); *H04R 2217/01* (2013.01); *H04R 2499/11* (2013.01)

(58) Field of Classification Search
CPC ..... H04R 17/00; H04R 17/02; H04R 17/06; H04R 17/10; H04R 2217/01; H04R 2499/11; H04R 7/20; H04R 31/003; H04R 2205/022
USPC ..... 381/114, 173, 182, 186, 370, 398, 190; 310/322, 324, 348
See application file for complete search history.

(56) References Cited

U.S. PATENT DOCUMENTS

| | | | | |
|---|---|---|---|---|
| 4,430,529 | A * | 2/1984 | Nakagawa | H04R 17/00 310/324 |
| 4,654,554 | A * | 3/1987 | Kishi | H04R 1/22 310/322 |
| 4,965,483 | A * | 10/1990 | Abe | G10K 9/122 310/324 |
| 5,430,803 | A | 7/1995 | Kimura et al. | |
| 6,472,797 | B1 | 10/2002 | Kishimoto | |
| 2003/0023937 | A1 * | 1/2003 | McManus | G06F 17/5068 257/204 |
| 2016/0119719 | A1 | 4/2016 | Doshida et al. | |
| 2016/0119720 | A1 | 4/2016 | Doshida et al. | |
| 2016/0119721 | A1 | 4/2016 | Doshida et al. | |
| 2016/0155926 | A1 | 6/2016 | Ishii et al. | |
| 2016/0157020 | A1 | 6/2016 | Ishii et al. | |
| 2016/0183006 | A1 | 6/2016 | Tokuhisa et al. | |

OTHER PUBLICATIONS

Non-Final Office Action issued by U.S. Patent and Trademark Office, dated Jan. 12, 2017, for U.S. Appl. No. 14/930,528.

* cited by examiner

A

B

ELECTROACOUSTIC TRANSDUCER

BACKGROUND

Field of the Invention

The present invention relates to an electroacoustic transducer that can be applied to earphones, headphones, mobile information terminals, etc., for example.

Description of the Related Art

Piezoelectric sounding bodies are widely used as simple means for electroacoustic conversion, where popular applications include earphones, headphones, and other acoustic devices as well as speakers for mobile information terminals, etc., for example. Piezoelectric sounding bodies are typically constituted by a vibration plate and a piezoelectric element attached to it (refer to Patent Literature 1, for example).

[Patent Literature 1] Japanese Patent Laid-open No. 2013-150305

SUMMARY

In recent years, there is a demand for higher sound quality in the field of earphones, headphones, and other acoustic devices. Accordingly, improving their electroacoustic conversion function characteristics is an absolute must for piezoelectric sounding bodies. When music is played, etc., for example, sibilant vocal sounds appearing in the high-frequency band may lead to lower sound quality. What is required, in this case, is electroacoustic conversion function with high-frequency characteristics capable of reducing sound pressure peaks of the sibilant sounds.

In light of the aforementioned situations, an object of the present invention is to provide an electroacoustic transducer offering excellent high-frequency characteristics.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, an electroacoustic transducer pertaining to an embodiment of the present invention has a housing, piezoelectric speaker, dynamic speaker, and support member.

The piezoelectric speaker includes a vibration plate having a first surface and a second surface on the opposite side of the first surface, as well as a piezoelectric element joined to at least one of the first surface and second surface, and divides the interior of the housing into a first space facing the first surface and a second space facing the second surface.

The dynamic speaker is placed in the first space.

The support member is constituted by a part of the housing or by a member different from the housing, has a supporting part facing the first surface or second surface, and supports the periphery of the first surface or second surface with the supporting part.

With the aforementioned electroacoustic transducer, the support member supports the periphery of either surface of the vibration plate. This way, greater freedom of vibration of the periphery of the vibration plate is permitted when the piezoelectric element is driven, compared to when the entire periphery of each surface of the vibration plate is firmly fixed to the support member, and desired high-frequency characteristics can be achieved as a result.

As explained above, according to the present invention, an electroacoustic transducer offering excellent high-frequency characteristics can be provided.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
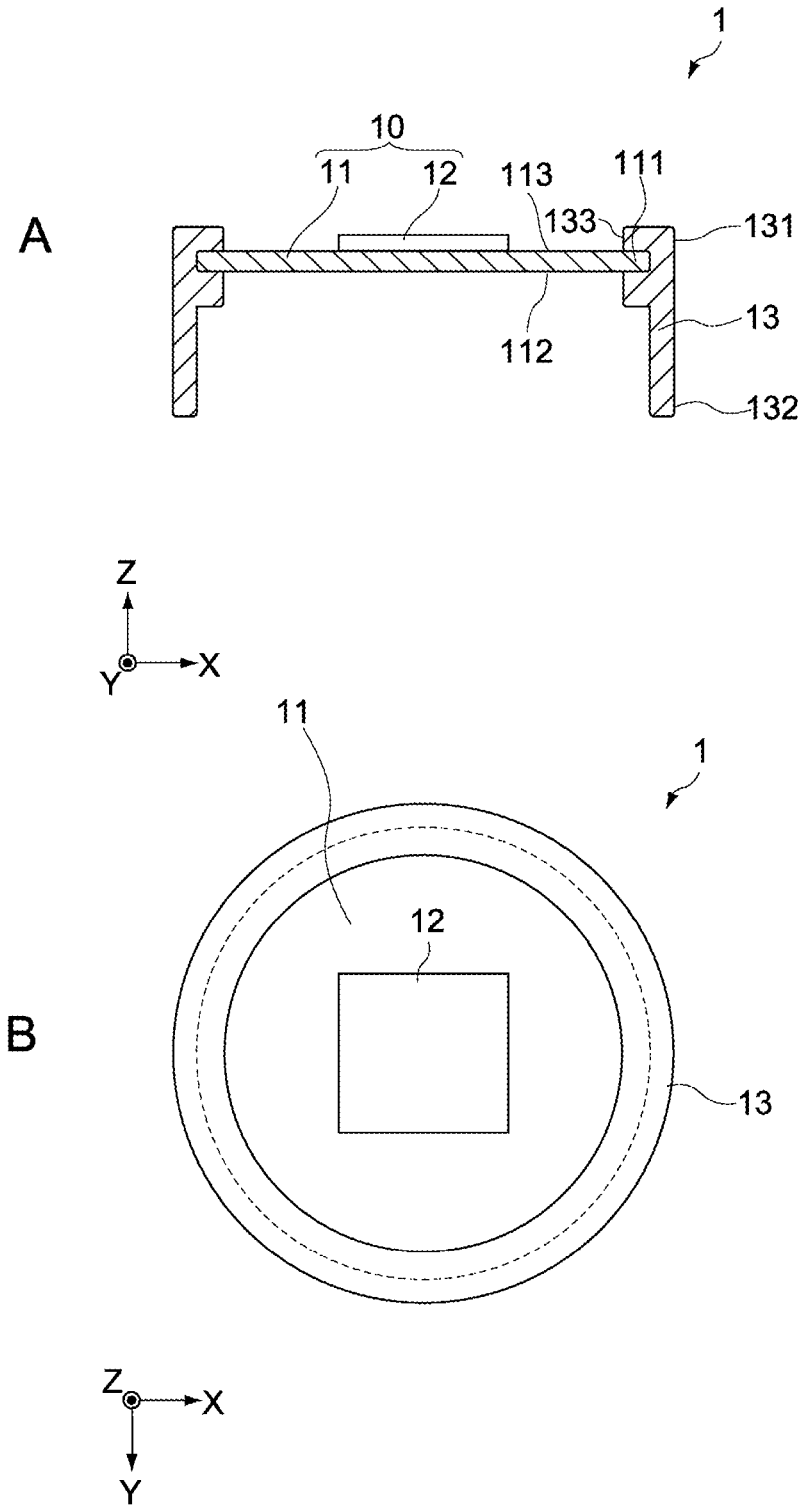
FIG. 1 is a schematic constitutional diagram of a speaker unit pertaining to a reference example of an embodiment of the present invention, where A is a lateral section view and B is a plan view.

2, 3, 4, 5, 6 - - - Speaker unit
20, 50 - - - Piezoelectric speaker
21, 51 - - - Vibration plate
22 - - - Piezoelectric element
23, 33, 43, 53, 63 - - - Support member
24 - - - Housing
25 - - - Dynamic speaker
26, 36, 46, 56, 66 - - - First adhesive layer
27, 37, 47, 57, 67 - - - Second adhesive layer
200, 300, 400, 500, 600, 800 - - - Electroacoustic transducer
211 - - - Periphery (of the vibration plate)
230, 330, 430, 530, 630 - - - Annular body
233, 433 - - - Projection
333 - - - Ring-shaped convex
511 - - - Projecting piece

DETAILED DESCRIPTION OF EMBODIMENTS

Embodiments of the present invention are explained below by referring to the drawings.

<Basic Constitution (Reference Example)>

First, the basic constitution of a speaker unit pertaining to a reference example of this embodiment is explained.

A and B in FIG. 1 are a lateral section view and plan view, respectively, schematically showing a speaker unit 1 pertaining to the reference example. In the figures, the X-, Y-, and Z-axes represent three axial directions intersecting at right angles (the same applies to the figures referenced hereinafter).

The speaker unit 1 has a piezoelectric speaker 10 with a vibration plate 11 and piezoelectric element 12, and a support member 13 that supports the piezoelectric speaker 10. The piezoelectric speaker 10 generates sound waves having a sound pressure peak near 8 kHz, for example, and is supported by the support member 13. The speaker unit 1 is housed inside a housing not illustrated here, to constitute an electroacoustic transducer for an earphone, headphone, etc.

As shown in B in FIG. 1, the vibration plate 11 is constituted by metal (such as 42 alloy) or other conductive material, or by resin (such as liquid crystal polymer) or other insulating material, and its planar shape is formed circular.

The outer diameter and thickness of the vibration plate 11 are not limited in any way, and can be set as deemed appropriate according to the frequency band of playback sound waves, etc., where, in this example, a disk-shaped vibration plate of approx. 12 mm in diameter and approx. 0.2 mm in thickness is used.

The piezoelectric element 12 functions as an actuator that vibrates the vibration plate 11. The piezoelectric element 12 is integrally joined to at least one of a first surface 112, and a second surface 113 on the opposite side of the first surface, of the vibration plate 11. In this example, the piezoelectric speaker 10 has a unimorph structure where the piezoelectric element 12 is joined to one surface of the vibration plate 11.

The piezoelectric element 12 may be joined to either surface of the vibration plate 11, where, in the example shown, the piezoelectric element 12 is joined to the second surface 113. The piezoelectric element 12 is placed roughly at the center of the vibration plate 11. This way, the vibration plate 11 can be oscillated and driven isotropically with respect to its entire in-plane area.

The planar shape of the piezoelectric element 12 is formed polygonal, and although it is a rectangle (oblong figure) in this example, the shape can be square, parallelogram, trapezoid or other quadrangle, or any polygon other than quadrangle, or circle, oval, ellipsoid, etc. The thickness of the piezoelectric element 12 is not limited in any way, either, and can be approx. 50 μm, for example.

The piezoelectric element 12 is structured as a stack of alternating multiple piezoelectric layers and multiple electrode layers. Typically the piezoelectric element 12 is made by sintering at a specified temperature a stack of alternating multiple ceramic sheets, each made of lead zirconate titanate (PZT), alkali metal-containing niobium oxide, etc., and having piezoelectric characteristics on one hand, and electrode layers on the other. One ends of respective electrode layers are led out alternately to both longitudinal end faces of the piezoelectric layer. The electrode layers exposed to one end face are connected to a first leader electrode layer, while the electrode layers exposed to the other end face are connected to a second leader electrode layer. The piezoelectric element 12 expands and contracts at a specified frequency when a specified AC voltage is applied between the first and second leader electrode layers, while the vibration plate 11 is vibrated at a specified frequency. The numbers of piezoelectric layers and electrode layers to be stacked are not limited in any way, and the respective numbers of layers are set as deemed appropriate so that the required sound pressure can be obtained.

The support member 13 is formed in a ring shape, where, in this example, it is shaped as a cylinder having the center of axis in the Z-axis direction. The support member 13 has a first end 131 and a second end 132 on the opposite side. Peripheries 111 of the first and second surfaces 112, 113 of the vibration plate 11 are supported all around by a retention part 133 provided at the first end 131. The support member 13 is constituted by an injection molding made of synthetic resin material, and typically the periphery 111 of the vibration plate 11 is firmly fixed to the retention part 133 in the form of insert molding.

Figure 2:
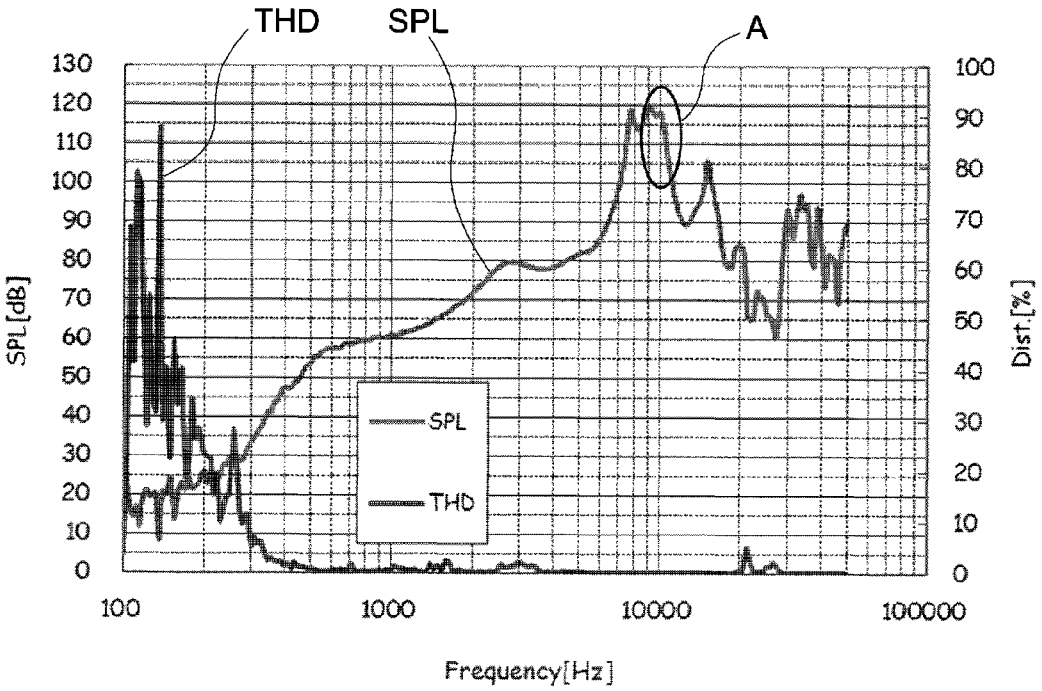
FIG. 2 shows results of an experiment showing the frequency characteristics of the speaker unit pertaining to the reference example.

FIG. 2 shows the oscillation frequency characteristics of the speaker unit 1 of the aforementioned constitution. In FIG. 2, the horizontal axis represents frequency [Hz] (logarithmic scale), the left vertical axis represents sound pressure level (SPL) [dB], and the right vertical axis represents total harmonic distortion (THD) [%], respectively.

As for the measurement, an earphone coupler was used to evaluate the characteristics according to the headphone and earphone standards (JEITA RC-8140A) by the Japan Electronics and Information Technology Industries Association.

As shown in FIG. 2, the speaker unit 1 pertaining to the reference example has the first sound pressure peak near 8 kHz, while the second sound pressure peak is also observed near 9 to 10 kHz as shown in oval area A in the figure. This second sound pressure peak is generally a cause of prominent sibilant vocal sounds in music and should desirably be suppressed as much as possible.

In the meantime, a relatively high Q value (sharpness of resonance) of the speaker unit 1 near 9 to 10 kHz is one reason why the second sound pressure peak emerges. It is therefore considered that the second sound pressure peak can be made to disappear if the Q value of the speaker unit near 9 to 10 kHz is reduced.

Accordingly, this invention provides an ingenious support structure for the vibration plate 11, the details of which are explained below, for the purpose of suppressing the sound pressure peak that may emerge in an unintended frequency band and thereby obtaining desired high-frequency characteristics.

First Embodiment

Figure 3:
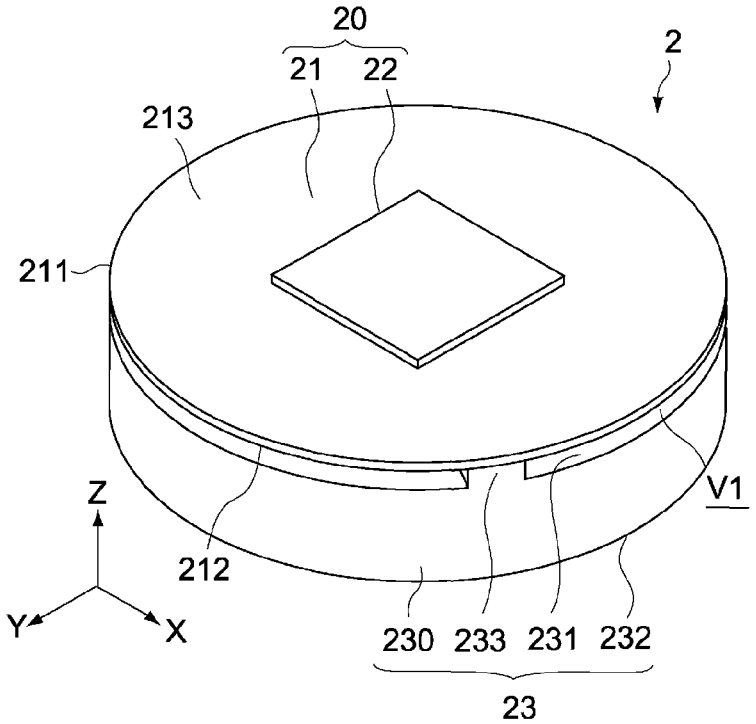
FIG. 3 is a general perspective view of the speaker unit of an electroacoustic transducer pertaining to the first embodiment of the present invention.
Figure 4:
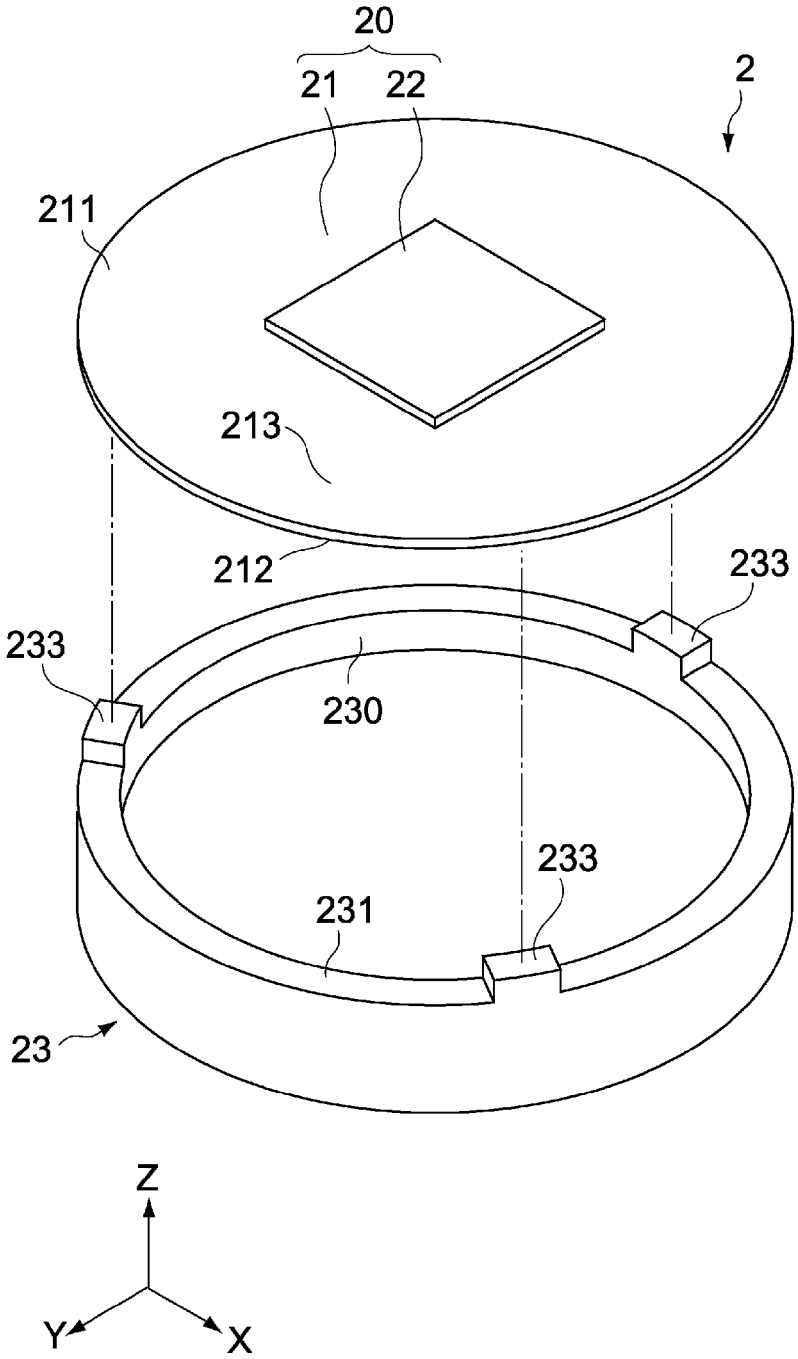
FIG. 4 is an exploded perspective view of the speaker unit shown in FIG. 3.
Figure 5:
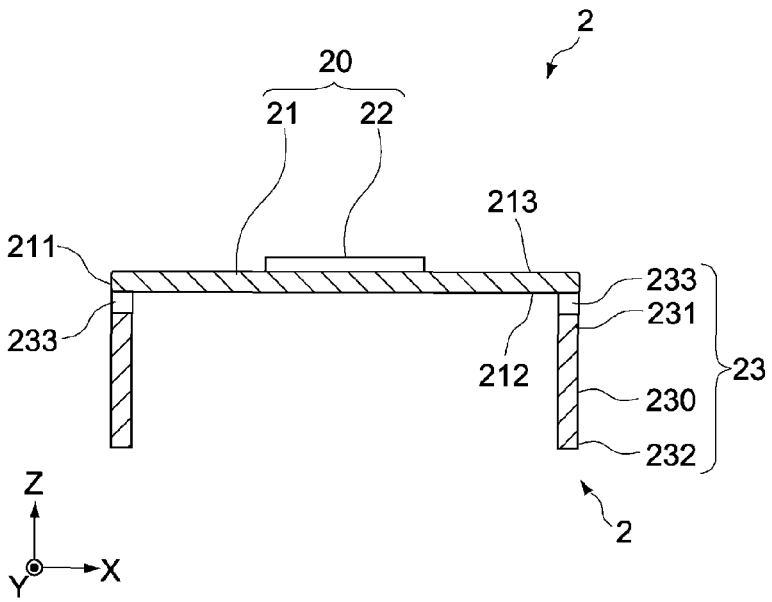
FIG. 5 is a schematic lateral section view of the speaker unit shown in FIG. 3.

FIG. 3 is a general perspective view of a speaker unit of the electroacoustic transducer pertaining to the first embodiment of the present invention, while FIG. 4 and FIG. 5 are an exploded perspective view and schematic lateral section view of the same, respectively.

A speaker unit 2 pertaining to this embodiment has a piezoelectric speaker 20 and support member 23. The speaker unit 2 is housed inside a housing not illustrated here, to constitute an electroacoustic transducer for an earphone, headphone, etc.

The piezoelectric speaker 20 has a vibration plate 21 having a first surface 212 and a second surface 213 on the opposite side of the first surface, as well as a piezoelectric element 22. The piezoelectric element 22 is integrally joined to at least one of the first surface 212 and second surface 213 of the vibration plate 21. In the example shown, the piezoelectric element 22 is joined to the second surface 213. The vibration plate 21 and piezoelectric element 22 are constitutionally identical to the vibration plate 11 and piezoelectric element 12 of the speaker unit 1 pertaining to the aforementioned reference example and therefore are not explained here.

The support member 23 has supporting parts (multiple projections 233) facing the first surface 212 of the vibration plate 21, and supports a periphery 211 of the vibration plate 21 with the supporting parts. The support member 23 may be constituted by a part of the housing or by a member different from the housing. It should be noted that, although the periphery 211 of the vibration plate 21 includes the periphery of the first surface 212, periphery of the second surface, and side surfaces of the vibration plate 21, the periphery 211 supported by the supporting parts corresponds to the periphery of the first surface 212, as described later.

In this embodiment, the support member 23 has an annular body 230, and multiple projections 233 to support the periphery 211 of the first surface 212 of the vibration plate 21. The multiple projections 233 correspond to the "supporting parts" that support the vibration plate 21. The support member 23 is constituted by an injection molding made of synthetic resin material, but the foregoing is not the only material and it can also be constituted by metal material.

The annular body 230 is constituted by an annular or cylindrical member of roughly the same outer diameter as that of the vibration plate 21, and has a first end 231 positioned on the first surface 212 side of the vibration plate 21 and a second end 232 on the opposite side. The thickness (height) of the annular body 230 in the Z-axis direction is not limited in any way so long as it is large enough to ensure sufficient strength to retain the piezoelectric speaker 20 in a stable manner.

The multiple projections 233 are provided in a manner facing the first surface 212 of the vibration plate 21 and also projecting axially (in the Z-axis direction) toward the first surface 212 of the vibration plate 21 from the first end 231 of the annular body 230. The multiple projections 233 have the same height and are spaced at equal or unequal angular intervals. This way, the periphery 211 of the vibration plate 21 is supported at multiple points by the multiple projections 233. There are three projections 233 in this embodiment, but the foregoing is not the only number of projections and there may be four or more projections. Since there are three or more projections 233, the vibration plate 21 can be supported within the XY plane in a stable manner.

The periphery 211 of the vibration plate 21 is supported at multiple points by the multiple projections 233. The periphery 211 of the vibration plate 21 is joined to the top surface of each projection 233 via adhesive agent or adhesive material.

The speaker unit of the aforementioned constitution generates sound waves with a sound pressure peak near 8 kHz, for example, as the vibration plate 21 vibrates at a specified frequency due to driving of the piezoelectric element 22. In this embodiment, multiple areas on the periphery 211 of the first surface 212 of the vibration plate 21 are partially supported by the multiple projections 233 of the support member 23. Accordingly, the second surface 213 of the vibration plate 21 becomes a free surface, and consequently more vibration of the periphery 211 is permitted compared to when the periphery of each surface of the vibration plate is firmly fixed all around as in the aforementioned reference example. As a result, desired high-frequency characteristics can be achieved.

Figure 6:
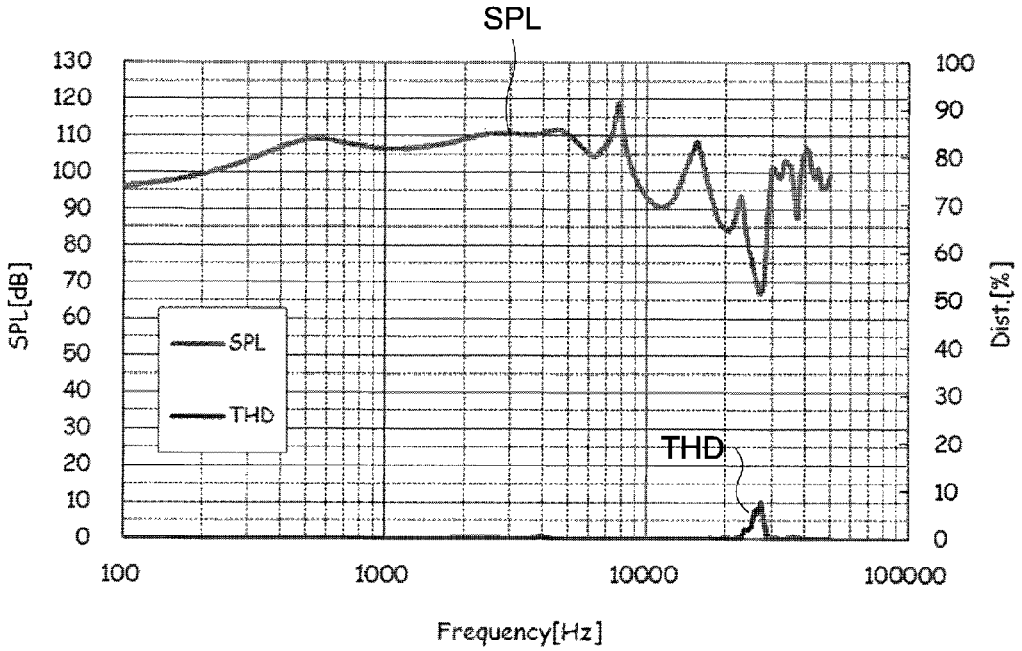
FIG. 6 shows results of an experiment showing the frequency characteristics of the speaker unit shown in FIG. 3.

FIG. 6 shows the oscillation frequency characteristics of the speaker unit 2 of the aforementioned constitution. As for the measurement, a method similar to the one used to measure the frequency characteristics pertaining to the reference example (FIG. 2) was adopted. It should be noted that, with the speaker unit 2 used in the measurement, each projection 233 is joined to the periphery 211 of the vibration plate 21 via adhesive agent or adhesive material.

As shown in FIG. 6, according to the speaker unit 2 of the aforementioned constitution, the second sound pressure peak present near 9 to 10 kHz (refer to FIG. 2) can be reduced or made to disappear while still maintaining the sound pressure peak near 8 kHz. This is probably due to the supporting of only the first surface 212 of the vibration plate 21 by the support member 23, which mitigates the supporting strength and symmetry of the periphery 211 compared to a structure where the periphery of each surface of the vibration plate is firmly fixed as in the aforementioned reference example. Mitigation of the supporting strength and symmetry of the periphery 211 of the vibration plate 21 means that the periphery 211 is more loosely fixed, which in turn increases the degree of freedom of vibration of the periphery 211 and consequently reduces the Q value of resonance. As explained above, optimizing the support structure of the vibration plate 21 in a manner reducing the sound pressure peak or making it disappear in the target frequency band (9 to 10 kHz in this embodiment) allows for easy achievement of desired high-frequency characteristics.

It was also confirmed that sound pressure levels in high-pitch bands of 10 kHz and above increased compared to those in the reference example. This is likely due to the excitation of higher-order resonance of the piezoelectric speaker partly because the periphery is not firmly fixed and partly because the symmetry of support is low. It was confirmed by the experiments conducted by the inventors of the present invention that the aforementioned effects became greater when the number of supports was low such as 3, 5 or 7 and the symmetry was low.

In order to optimize the vibration mode or vibration form of the periphery 211 of the vibration plate 21, the constitution may be such that the periphery 211 of the vibration plate 21 is elastically supported. In this case, the periphery 211 of the vibration plate 21 may be joined to each of the multiple projections 233 of the support member 23 via an elastically deformable adhesive material (first adhesive layer 26 in FIG. 7). Or, the speaker unit 2 may be further equipped with an elastically deformable adhesive layer that fills a void (void formed between the first end 231 of the annular body 230 and the periphery 211 of the vibration plate 21) V1 (refer to FIG. 3) formed between the multiple projections 233.

Figure 7:
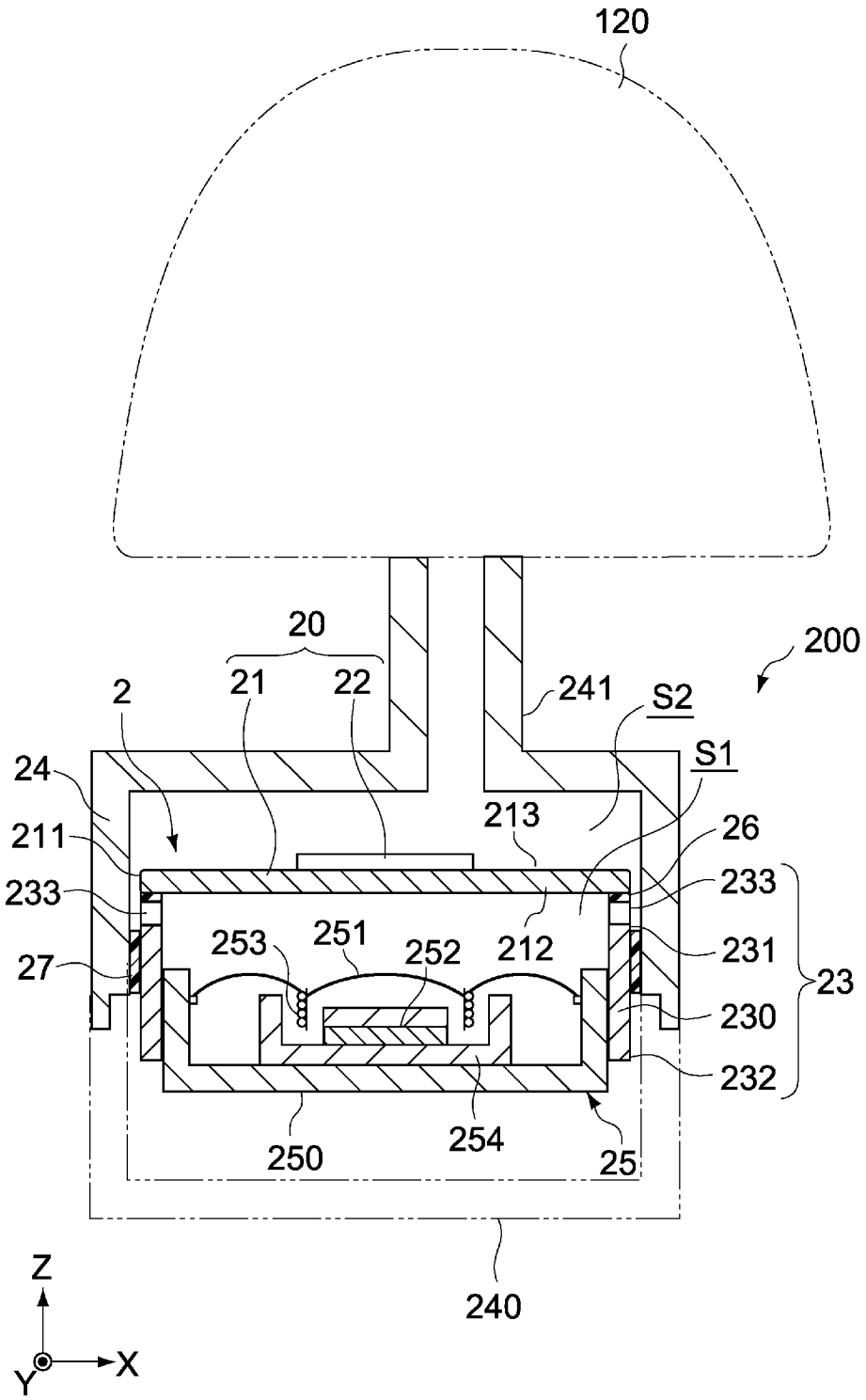
FIG. 7 is a schematic lateral section view showing the constitution of an electroacoustic transducer pertaining to the first embodiment of the present invention.

FIG. 7 is a schematic lateral section view of an electroacoustic transducer 200 that includes a speaker unit 2 of the aforementioned constitution. The electroacoustic transducer 200 in this embodiment is explained below.

The electroacoustic transducer 200 in this embodiment includes a housing 24, and a speaker unit 2 having a dynamic speaker 25. The electroacoustic transducer 200 can be utilized, for example, as an earphone, etc., by installing an ear piece 120 on a sound passage 241. However, its utilization is not limited to the foregoing.

The housing 24 has a case 240 detachable/reattachable in the Z-axis direction. The interior of the housing 24 is divided into a first space S1 facing a first surface 212 and second space S2 facing a second surface 213, by a piezoelectric speaker 20.

A periphery 211 of a vibration plate 21 is joined to each of multiple projections 233 of a support member 23 via an elastically deformable first adhesive layer 26. The first adhesive layer 26 is provided between the periphery 211 of the vibration plate 21 and the multiple projections 233. This way, the periphery 211 of the vibration plate 21 is elastically supported by the support member 23, and therefore the vibration mode or vibration pattern of the periphery 211 of the vibration plate 21 can be optimized.

Also, an elastically deformable second adhesive layer 27 is provided between the housing 24 and support member 23. The second adhesive layer 27 may be provided circularly at a specified area around an annular body 230, or provided partially at multiple locations around the annular body 230. The second adhesive layer 27 is constituted in the same manner as the first adhesive layer 26. This way, the vibration insulating effect between the housing 24 and speaker unit 2 is enhanced, which means that, for example, the vibration plate 21 can be vibrated stably at desired vibration characteristics.

The first adhesive layer 26 and second adhesive layer 27 are not specifically limited so long as they are adhesive material that exhibits elasticity when cured, but typically they are constituted by silicone resin, urethane resin, or other elastically deformable resin material. Alternatively, these adhesive layers may be constituted by double-sided tape (double-sided adhesive tape). Constituting the adhesive layers with double-sided tape makes it easy to control their thickness.

Additionally, these adhesive layers may include spherical insulation fillers of uniform grain size. By constituting each adhesive layer with adhesive material in which such insulation fillers are dispersed, the thickness of each adhesive layer can be adjusted accurately. This allows for highly accurate control of the vibration damping function of the vibration plate 21 by each adhesive layer, making it possible to achieve desired high-frequency characteristics in a stable manner.

The dynamic speaker 25 is placed inside the first space S1 in a manner facing the piezoelectric speaker 20 (vibration plate 21) in the Z-axis direction. In this embodiment, the dynamic speaker 25 is accommodated inside the annular body 230 constituted by a cylindrical member. However, in addition to the above, the dynamic speaker 25 may be supported by a member different from the support member 23.

The dynamic speaker 25 includes a vibration body such as a voice coil motor (solenoid coil), and is constituted as a speaker unit (woofer) that primarily generates low-pitch sound waves of 7 kHz and lower, for example. The dynamic speaker 25 in this embodiment has a casing 250, vibration plate 251 vibratively supported on the casing 250, permanent magnet 252, voice coil 253, and yoke 254 that supports the permanent magnet 252. The voice coil 253 is formed by a conductive wire wound around a bobbin serving as a winding core, and is joined to the center of the vibration plate 251. Also, the voice coil 253 is positioned vertically (in the Y-axis direction in the figure) to the direction of the magnetic flux of the permanent magnet 252. As AC current (voice signal) flows through the voice coil, electromagnetic force acts upon the voice coil 253 and therefore the voice coil 253 vibrates in the Z-axis direction in the figure according to the signal waveform. This vibration is transmitted to the vibration plate 251 coupled to the voice coil 253 and vibrates the air inside the first space S1, and low-pitch sound waves generate as a result.

On the other hand, the piezoelectric speaker 20 is constituted as a speaker unit (tweeter) that primarily generates high-pitch sound waves of 7 kHz and higher, for example. The piezoelectric speaker 20 vibrates the vibration plate 21 by inputting voice signals to the piezoelectric element 22, and generates sound waves in the aforementioned high-pitch bands in the sound passage 241 via the second space S2. This way, an electroacoustic transducer can be constituted as a hybrid speaker having a low-pitch sounding body and a high-pitch sounding body.

In general, a hybrid speaker is known to easily generate sibilant sounds in a high-frequency band near 9 to 10 kHz. In other words, sound pressure peaks that are not conspicuous when a tweeter alone is used often become prominent when a woofer is combined, and this leads to amplification of sibilant sounds to a level where they can no longer be ignored. The present invention is particularly effective in such a hybrid speaker, as it modifies the support structure of the piezoelectric speaker to reduce sibilant sounds considerably.

Also in this embodiment, the void V1 formed between the multiple projections 233 is constituted as a passage to let the sound generated by the dynamic speaker 25 pass through (refer to FIG. 3). This makes it easier to adjust the frequency characteristics of the low-pitch sound waves played back by the dynamic speaker 25 and reaching the sound passage 241. This also makes it possible to optimize the frequency characteristics around the intersection between the high-pitch sound characteristic curve played back by the piezoelectric speaker 20 and the low-pitch sound characteristic curve played back by the dynamic speaker 25.

Second Embodiment

Figure 8:
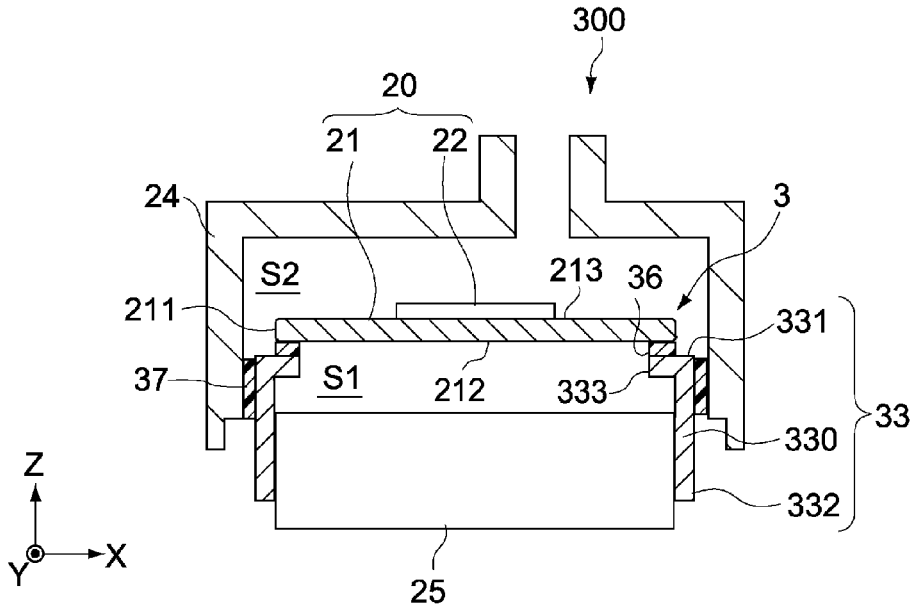
FIG. 8 is a schematic lateral section view of an electroacoustic transducer pertaining to the second embodiment of the present invention.

FIG. 8 is a schematic lateral section view showing the constitution of an electroacoustic transducer 300 pertaining to the second embodiment of the present invention. Constitutions different from those of the first embodiment are primarily explained below, and the same constitutions as in the first embodiment are not explained or explained briefly using the same symbols.

The electroacoustic transducer 300 in this embodiment includes a speaker unit 3 having a dynamic speaker 25, and a housing 24, as shown in FIG. 8. It should be noted that the interior structure of the dynamic speaker 25 is not illustrated.

In this embodiment, a support member 33 has a supporting part (ring-shaped convex 333) facing a first surface 212 of a vibration plate 21, and supports a periphery 211 of the vibration plate 21 with the supporting part. The support member 33 may be constituted by a part of the housing or by a member different from the housing.

The support member 33 has an annular body 330, and a ring-shaped convex 333 that supports the periphery 211 of the vibration plate 21. The ring-shaped convex 333 corresponds to the "supporting part" that supports the vibration plate 21. The support member 33 is constituted by an injection molding made of synthetic resin material, but the foregoing is not the only material and it can also be constituted by metal material.

The annular body 330 is constituted by an annular or cylindrical member of an outer diameter greater than the outer diameter of the vibration plate 21, and has a first end 331 positioned on the first surface 212 side of the vibration plate 21 and a second end 332 on the opposite side.

The ring-shaped convex 333 is provided in a manner facing the first surface 212 of the vibration plate 21 and also projecting diametrically inward from the inner periphery surface of the first end 331 of the annular body 330. The ring-shaped convex 333 is formed with an outer diameter equivalent to or greater than the outer diameter of the vibration plate 21, and is constituted in such a way that it can support the periphery 211 of the first surface 212 of the vibration plate 21 all around. It should be noted that the ring-shaped convex 333 may be constituted by multiple arc-shaped convexes arranged at regular or irregular intervals along the same circumference, in which case the vibration plate 21 is supported by multiple areas on the periphery 211 of the first surface 212.

Then, the periphery 211 of the vibration plate 21 is joined to the top surface of the ring-shaped convex 333 via an elastically deformable first adhesive layer 36. The first adhesive layer 36 is constituted in the same manner as the first adhesive layer 26 (refer to FIG. 7) explained in the first embodiment. This way, the periphery 211 of the vibration plate 21 is elastically supported by the support member 33, and therefore the vibration mode or vibration pattern of the periphery 211 of the vibration plate 21 can be optimized.

Additionally, the dynamic speaker 25 is placed inside the support member 33 in a manner facing the Z-axis direction of a piezoelectric speaker 20 (vibration plate 21). In this embodiment, the annular body 330 is constituted by a cylindrically shaped member, and the outer periphery surface of the dynamic speaker 25 is bonded and fixed to the inner periphery surface of the second end 332 thereof. However, in addition to the above, the dynamic speaker 25 may be supported by a member different from the support member 33.

Also, in this embodiment an elastically deformable second adhesive layer 37 is provided between the support member 33 and housing 24. The second adhesive layer 37 is constituted in the same manner as the second adhesive layer 27 (refer to FIG. 7) explained in the first embodiment. This way, the vibration insulating effect between the housing 24 and speaker unit 3 is enhanced.

Figure 9:
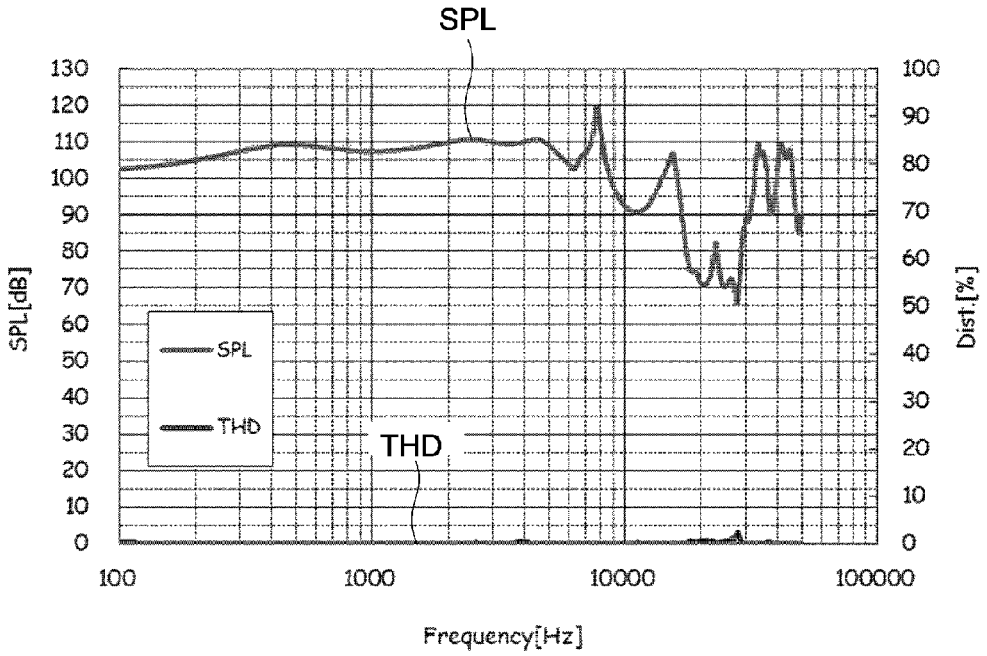
FIG. 9 shows results of an experiment showing the frequency characteristics of the speaker unit of an electroacoustic transducer pertaining to the second embodiment of the present invention.

FIG. 9 shows the results of an experiment showing the oscillation frequency characteristics of the speaker unit 3 in this embodiment.

As for the measurement, a method similar to the one used to measure the frequency characteristics pertaining to the reference example (FIG. 2) was adopted.

As shown in FIG. 9, according to the speaker unit 3 of this embodiment the second sound pressure peak present near 9 to 10 kHz (refer to FIG. 2) can be reduced or made to disappear while still maintaining the sound pressure peak near 8 kHz, just like in the first embodiment. This is probably due to the elastic supporting of only the periphery 211 of the first surface 212 of the vibration plate 21 by the support member 33 via the first adhesive layer 36, which mitigates the supporting strength of the periphery 211 compared to a structure where the periphery of the vibration plate is firmly fixed as in the aforementioned reference example. Mitigation of the supporting strength of the periphery 211 means that the periphery 211 is more loosely fixed, which in turn increases the degree of freedom of vibration of the periphery 211 and consequently reduces the Q value of resonance. As explained above, optimizing the support structure of the vibration plate 21 in a manner reducing the sound pressure peak or making it disappear in the target frequency band (9 to 10 kHz in this embodiment) allows for easy achievement of desired high-frequency characteristics. Also in this embodiment, THD decreased. This is probably due to the suppression of nonlinearity as the periphery 211 is supported in a softer manner.

Figure 10:
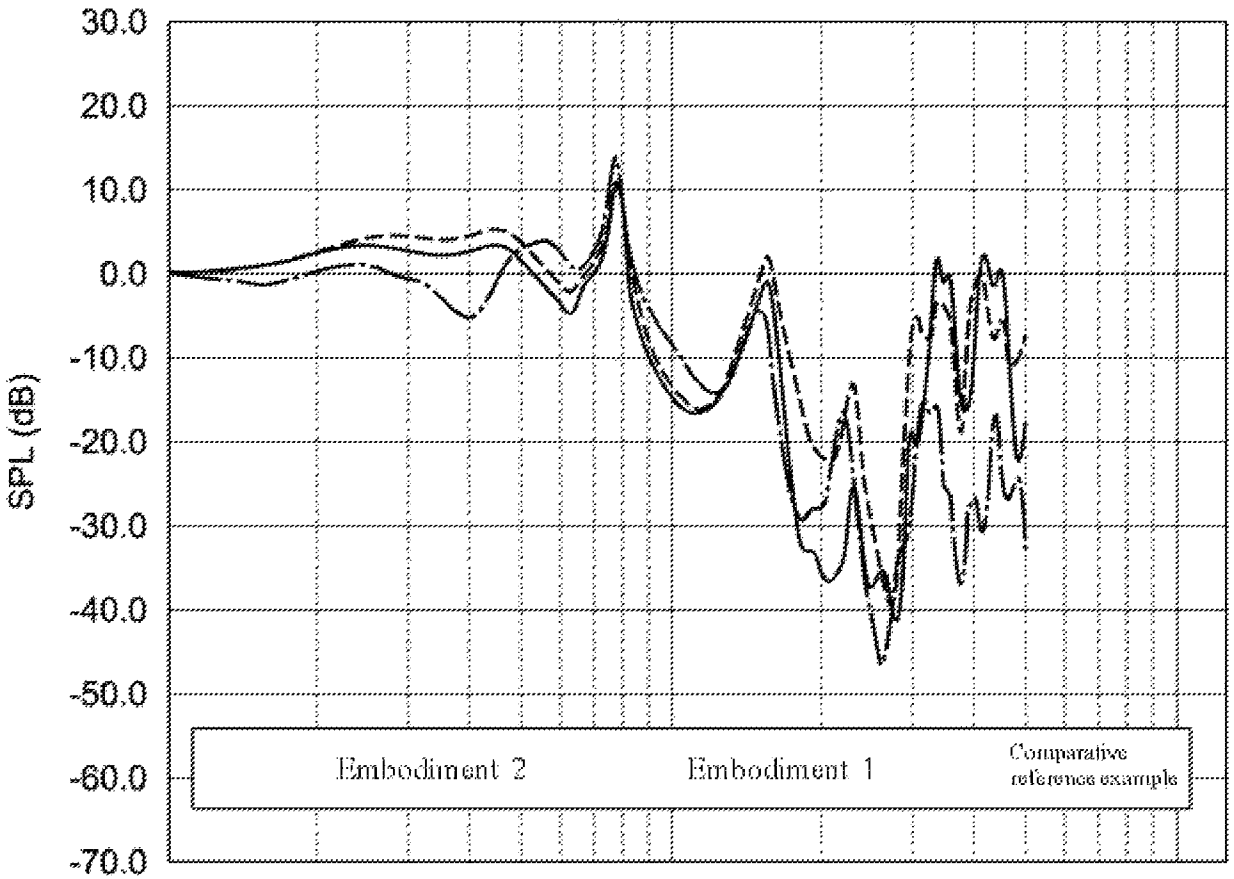
FIG. 10 is a graph comparing the frequency characteristics of the speaker unit of the electroacoustic transducer pertaining to the first embodiment of the present invention and the speaker unit of the electroacoustic transducer pertaining to the second embodiment of the present invention.

FIG. 10 shows the results of an experiment showing the high-frequency characteristics of the speaker unit 3 pertaining to this embodiment and the speaker unit 2 pertaining to the first embodiment mentioned above. For the purpose of comparison, the high-frequency characteristics of a commercially available canal-type earphone are also shown. It should be noted that, in the figure, the solid line, broken line, and one-dot chain line represent the high-frequency characteristics of the speaker unit 3 in this embodiment, speaker unit 2 in the first embodiment, and commercially available canal-type earphone, respectively.

Third Embodiment

Figure 11:
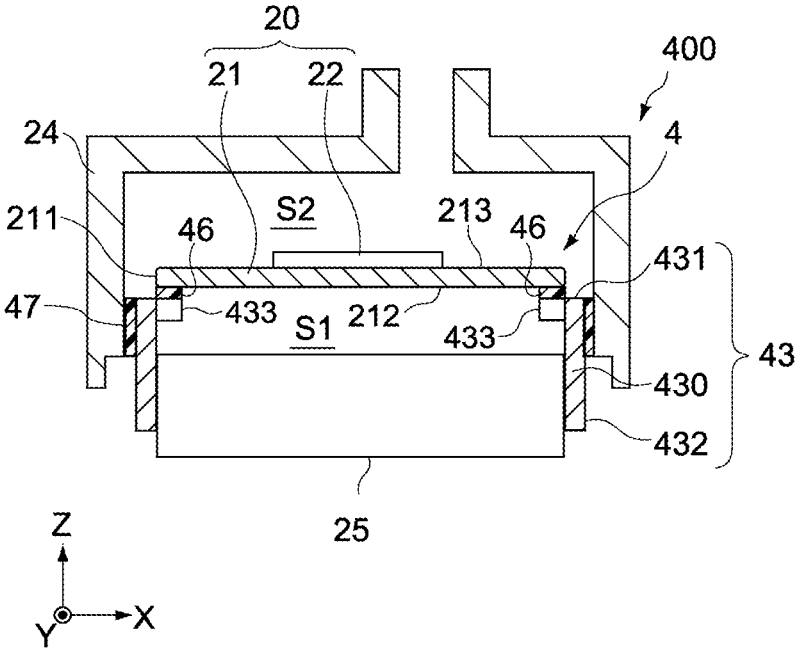
FIG. 11 is a schematic constitutional diagram of an electroacoustic transducer pertaining to the third embodiment of the present invention, where A is a lateral section view and B is a plan view.
Figure 11:
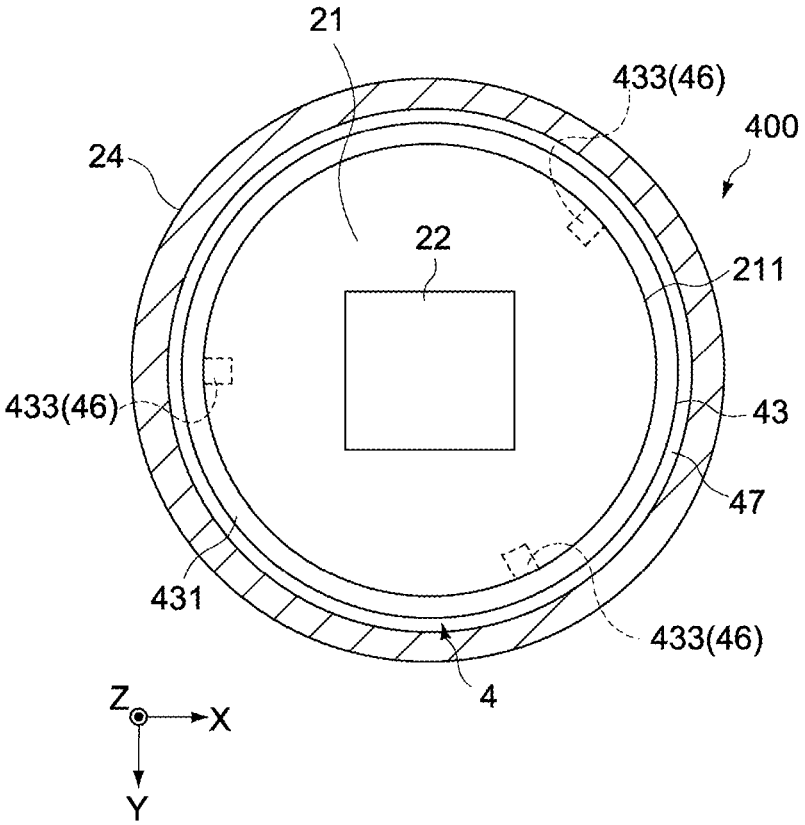

A and B in FIG. 11 are a schematic lateral section view and cross section view, respectively, showing the constitution of an electroacoustic transducer 400 being an electroacoustic transducer pertaining to the third embodiment of the present invention. Constitutions different from those of the first embodiment are primarily explained below, and the same constitutions as in the first embodiment are not explained or explained briefly using the same symbols.

The electroacoustic transducer 400 in this embodiment has a speaker unit 4 with a dynamic speaker 25, and a housing 24, as shown in A in FIG. 11. It should be noted that the interior structure of the dynamic speaker 25 is not illustrated.

In this embodiment, a support member 43 has supporting parts (multiple projections 433) facing a first surface 212 of a vibration plate 21, and supports a periphery 211 of the vibration plate 21 with the supporting parts.

The support member 43 may be constituted by a part of the housing or by a member different from the housing.

The support member 43 has an annular body 430, and multiple projections 433 to support the periphery 211 of the vibration plate 21. The multiple projections 433 correspond to the "supporting parts" that support the vibration plate 21. The support member 43 is constituted by an injection molding made of synthetic resin material, but the foregoing is not the only material and it can also be constituted by metal material.

The annular body 430 is constituted by an annular or cylindrical member of an inner diameter equivalent to or greater than the outer diameter of the vibration plate 21, and has a first end 431 positioned on the periphery 211 side of the vibration plate 21 and a second end 432 on the opposite side.

The multiple projections 433 are provided in a manner facing the first surface 212 of the vibration plate 21 and also projecting diametrically inward from the inner periphery surface of the first end 431 of the annular body 430, so that partial supporting of the periphery 211 of the first surface 212 of the vibration plate 21 becomes constitutionally possible. The multiple projections 433 have the same width (projected amount) and are spaced at equal or unequal angular intervals. The projected amount of each projection 433 is not specifically limited so long as it is large enough to support the periphery 211 of the vibration plate 21.

Then, the periphery 211 of the vibration plate 21 is joined to the top surface of each projection 433 via an elastically deformable first adhesive layer 46. The first adhesive layer 46 is constituted in the same manner as the first adhesive layer 26 (refer to FIG. 7) explained in the first embodiment. This way, the periphery 211 of the vibration plate 21 is elastically supported by the support member 43, and therefore the vibration mode or vibration pattern of the periphery 211 of the vibration plate 21 can be optimized.

The dynamic speaker 25 is placed inside the support member 43 in a manner facing the Z-axis direction of a piezoelectric speaker 20 (vibration plate 21). In this embodiment, the annular body 430 is constituted by a cylindrically shaped member, and the outer periphery surface of the dynamic speaker 25 is bonded and fixed to the inner periphery surface of the second end 432 thereof. In addition to the above, the dynamic speaker 25 may be supported by a member different from the support member 43.

Also, in this embodiment an elastically deformable second adhesive layer 47 is provided between the support member 43 and housing 24. The second adhesive layer 47 is constituted in the same manner as the second adhesive layer 27 (refer to FIG. 7) explained in the first embodiment. This way, the vibration insulating effect between the housing 24 and speaker unit 4 is enhanced.

As explained above, the electroacoustic transducer 400 in this embodiment is constituted so that a second surface 213 of the vibration plate 21 acts as a free surface and only the periphery 211 of the first surface 212 is supported by the support member 43. This way, operations and effects can be achieved that are similar to those in the first embodiment. Also according to this embodiment, the supporting parts that support the vibration plate 21 are constituted by multiple projections 433 projecting diametrically inward from the annular body 430, which allows the vibration plate 21 to be supported stably with the target high frequency characteristics even when the inner diameter of the annular body 430 is equal to or greater than the outer diameter of the vibration plate 21.

Fourth Embodiment

Figure 12:
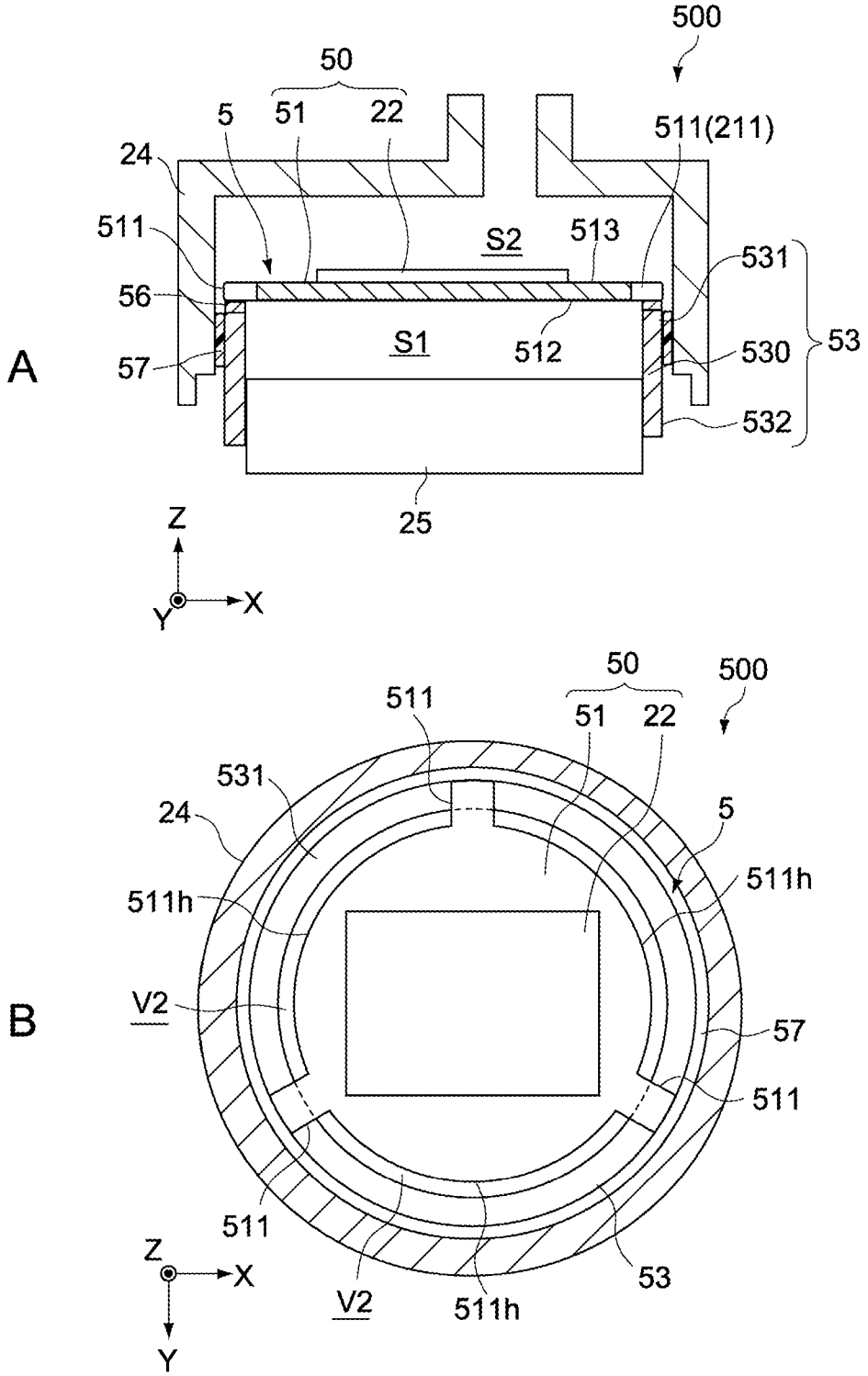
FIG. 12 is a schematic constitutional diagram of an electroacoustic transducer pertaining to the fourth embodiment of the present invention, where A is a lateral section view and B is a plan view.

A and B in FIG. 12 are a schematic lateral section view and cross section view, respectively, showing the constitution of an electroacoustic transducer 500 pertaining to the fourth embodiment of the present invention. Constitutions different from those of the first embodiment are primarily explained below, and the same constitutions as in the first embodiment are not explained or explained briefly using the same symbols.

The electroacoustic transducer 500 in this embodiment has a speaker unit 5 with a piezoelectric speaker 50 and dynamic speaker 25, and a housing 24, as shown in A in FIG. 12. It should be noted that the interior structure of the dynamic speaker 25 is not illustrated.

The piezoelectric speaker 50 has a vibration plate 51 and piezoelectric element 22.

The vibration plate 51 is shaped roughly as a disk constituted by conductive material or resin material, and has a first surface 512 facing the dynamic speaker 25 and a second surface 513 on the opposite side, and its periphery has multiple projecting pieces 511 that project radially toward the perimeter. The multiple projecting pieces 511 are typically formed at equal angular intervals, but they may also be formed at unequal intervals. The multiple projecting pieces 511 are formed by, for example, providing multiple cutouts 511*h* along the periphery of the vibration plate 51. The projected amount of the projecting piece 511 is adjusted by the cut-out depth of the cutout 511*h*. The number of projecting pieces 511 is three in the example shown, but it may be four or more. This way, the vibration plate 21 can be supported within the XY plane in a stable manner.

On the other hand, a support member 53 has a supporting part (first end 531) facing the first surface 512 of the vibration plate 51, and supports the periphery (multiple projecting pieces 511) of the vibration plate 51 with the supporting part. In this embodiment, the support member 53 supports each projecting piece 511 of the vibration plate 51. The support member 53 may be constituted by a part of the housing or by a member different from the housing.

The support member 53 has an annular body 530, and the annular body 530 is constituted by an annular or cylindrical member of roughly the same outer diameter as that of the vibration plate 51, and has a first end 531 positioned on the periphery (multiple projecting pieces 511) side of the vibration plate 51 and a second end 532 on the opposite side. The first end 531 corresponds to the "supporting part" that supports the vibration plate 21, and is constituted in a manner partially supporting the tip of each projecting piece 511, as shown in B in FIG. 12. The support member 53 is constituted by an injection molding made of synthetic resin material, but the foregoing is not the only material and it can also be constituted by metal material.

An elastically deformable first adhesive layer 56 is provided between each projecting piece 511 and the top surface of the first end 531. The first adhesive layer 56 may be constituted in the same manner as the first adhesive layer 26 (refer to FIG. 7) explained in the first embodiment. This way, each projecting piece 511 of the vibration plate 51 is elastically supported by the support member 53, and therefore the vibration mode or vibration pattern of the periphery of the vibration plate 51 can be optimized.

Also, the dynamic speaker 25 is placed inside the support member 53 in a manner facing the Z-axis direction of a piezoelectric speaker 50 (vibration plate 51). In this embodiment, the annular body 530 is constituted by a cylindrically shaped member, and the outer periphery surface of the dynamic speaker 25 is bonded and fixed to the inner periphery surface of the second end 532 thereof. In addition to the above, the dynamic speaker 25 may be supported by a member different from the support member 53.

Also, in this embodiment an elastically deformable second adhesive layer 57 is provided between the support member 53 and housing 24. The second adhesive layer 57 is constituted in the same manner as the second adhesive layer 27 (refer to FIG. 7) explained in the first embodiment. This way, the vibration insulating effect between the housing 24 and speaker unit 5 is enhanced.

With the electroacoustic transducer 500 in this embodiment as constituted above, the vibration plate 51 is constitutionally supported via the multiple projecting pieces 511 formed on its periphery, where the second surface 513 acts as a free surface and only the first surface 512 is supported on the first end 531 of the support member 53, and therefore binding of the periphery of the vibration plate 51 is mitigated. This way, operations and effects can be achieved that are similar to those in the first embodiment.

Also in this embodiment, a void V2 (cutout 511*h*) formed between the multiple projecting pieces 511 may be constituted as a passage to let the sound generated by the dynamic speaker 25 pass through. This way, it becomes possible to adjust the frequency characteristics of the sound waves played back by the dynamic speaker 25. This also makes it possible to optimize the frequency characteristics around the intersection between the high-pitch sound characteristic curve played back by the piezoelectric speaker 50 and the low-pitch sound characteristic curve played back by the dynamic speaker 25.

Fifth Embodiment

Figure 13:
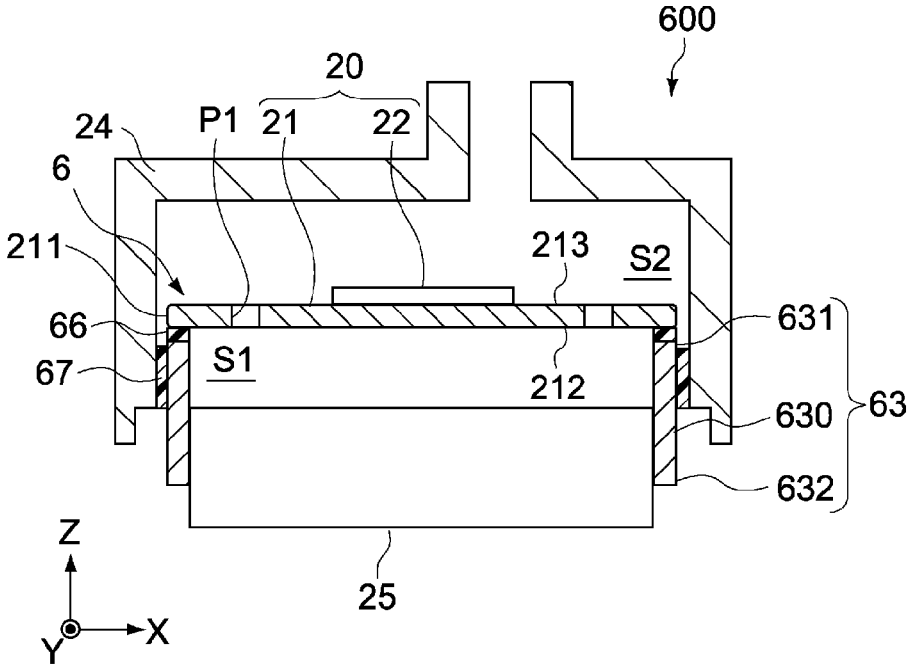
FIG. 13 is a schematic lateral section view of an electroacoustic transducer pertaining to the fifth embodiment of the present invention.

FIG. 13 is a schematic lateral section view showing the constitution of an electroacoustic transducer 600 being an electroacoustic transducer pertaining to the fifth embodiment of the present invention. Constitutions different from those of the first embodiment are primarily explained below, and the same constitutions as in the first embodiment are not explained or explained briefly using the same symbols.

The electroacoustic transducer 600 in this embodiment has a speaker unit 6 with a dynamic speaker 25, and a housing 24, as shown in FIG. 13. It should be noted that the interior structure of the dynamic speaker 25 is not illustrated.

In this embodiment, a support member 63 has a supporting part (first end 631) facing a first surface 212 of a vibration plate 21, and supports a periphery 211 of the vibration plate 21 with the supporting part.

The support member 63 may be constituted by a part of the housing or by a member different from the housing.

The support member 63 is constituted by an annular body 630. The annular body 630 is constituted by an annular or cylindrical member of roughly the same outer diameter as that of the vibration plate 21, and has a first end 631 positioned on the periphery 211 side of the vibration plate 21 and a second end 632 on the opposite side. The first end 631 corresponds to the "supporting part" that supports the vibration plate 21, and supports the periphery 211 of the first surface 212 of the vibration plate 21 all around. The support member 63 is constituted by an injection molding made of synthetic resin material, but the foregoing is not the only material and it can also be constituted by metal material.

Also, a first adhesive layer 66 is provided between the first end 631 of the support member 63 and the periphery 211 of the vibration plate 21. The first adhesive layer 66 is constituted in the same manner as the first adhesive layer 26 (refer to FIG. 7) explained in the first embodiment. This way, the periphery 211 of the vibration plate 21 is elastically supported by the support member 63, and therefore the vibration mode or vibration pattern of the periphery 211 of the vibration plate 21 can be optimized.

Also, the dynamic speaker 25 is placed inside the support member 63 in a manner facing the Z-axis direction of a piezoelectric speaker 20 (vibration plate 21). In this embodiment, the annular body 630 is constituted by a cylindrically shaped member, and the outer periphery surface of the dynamic speaker 25 is bonded and fixed to the inner periphery surface of the second end 632 thereof. In addition to the above, the dynamic speaker 25 may be supported by a member different from the support member 63.

Also, in this embodiment an elastically deformable second adhesive layer 67 is provided between the support member 63 and housing 24. The second adhesive layer 67 is constituted in the same manner as the second adhesive layer 27 (refer to FIG. 7) explained in the first embodiment. This way, the vibration insulating effect between the housing 24 and speaker unit 6 is enhanced.

Figure 14:
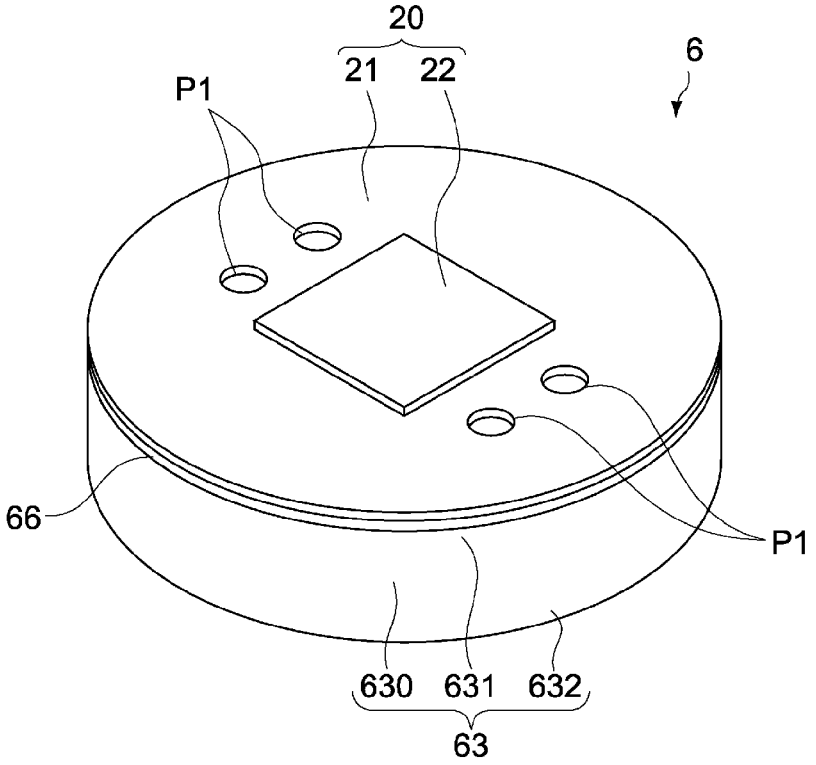
FIG. 14 is a general perspective view of the speaker unit of the electroacoustic transducer shown in FIG. 13.

In this embodiment, passages P1 that connect a first space S1 and a second space S2 are provided at the vibration plate 21 of the piezoelectric speaker 20. FIG. 14 is a schematic perspective view showing the constitution of the speaker unit 6.

The passages P1 are provided in the thickness direction of the vibration plate 21. In this embodiment, the passages P1 are each constituted by multiple through holes provided in the vibration plate 21. As shown in FIG. 14, the passage P1 is formed at multiple locations around a piezoelectric element 22 (area between any desired side of the piezoelectric element 22 and the periphery of the vibration plate 21). In this embodiment, the piezoelectric element 22 has a rectangular planar shape, so sufficient area in which to form the passages P1 can be secured without limiting the size of the piezoelectric element 22 more than necessary.

The passages P1 are used to pass some of the sound waves generated by the dynamic speaker 25 from the first space S1 to the second space S2. Accordingly, low-pitch sound frequency characteristics can be adjusted or tuned by the number of passages P1, passage size, etc., meaning that the number of passages P1, passage size, etc., are determined according to the desired low-pitch sound frequency characteristics. Because of this, the number of passages P1 and passage size are not limited to those in the example of FIG. 14, and there may be one passage P1, for example.

It should be noted that, if multiple through holes are provided at the vibration plate 21 as passages P1, the rigidity of the vibration plate 21 may drop where the through holes are provided. In light of the above, optimizing the positions, number and size of the passages P1 mitigates resonance of the periphery 211 in unintended high-frequency bands and thereby permits achievement of desired high-frequency characteristics of the vibration plate 21. In this case, the passages P1 may be designed in such a way that desired frequency characteristics of the low-pitch sound waves generated by the dynamic speaker 25, as mentioned above, can also be achieved.

On the other hand, the passages P1 are each constituted by a through hole penetrating the vibration plate 21 in its thickness direction, so the sound wave propagation path from the first space S1 to the second space S2 can be minimized (made the shortest). This makes it easier to set a sound pressure peak in a specified low-pitch sound range.

The foregoing explained embodiments of the present invention, but the present invention is not limited to the aforementioned embodiments and it goes without saying that various modifications may be added.

Figure 15:
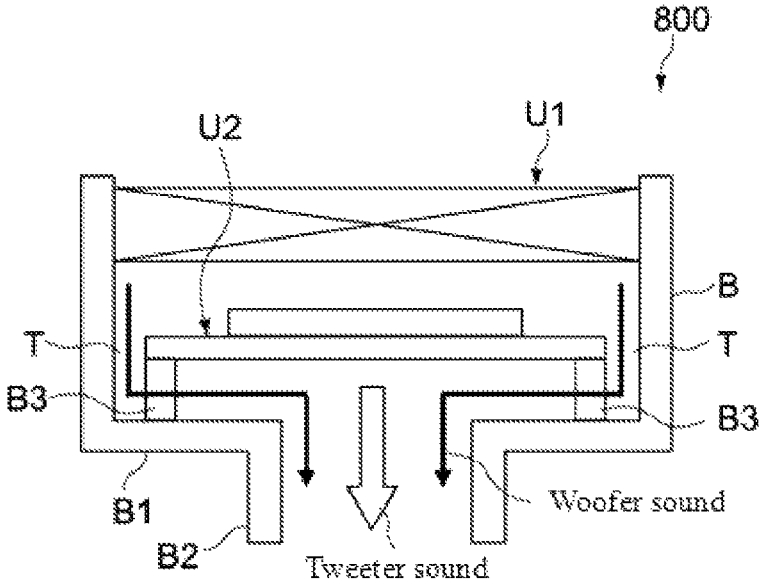
FIG. 15 is a lateral section view showing a constitutional variation example of the electroacoustic transducer pertaining to the present invention.

For example, in each of the aforementioned embodiments the vibration plate of the piezoelectric speaker is supported, by the support member, at its periphery on the surface (first surface) on the side facing the dynamic speaker; however, a constitution where the periphery of the surface (second surface) on the side not facing the dynamic speaker is supported by the support member can also be adopted. For example, with an electroacoustic transducer 800 schematically shown in FIG. 15, the constitution is such that a dynamic speaker U1 and piezoelectric speaker U2 are housed inside a housing B, respectively, so that the sound waves generated by the sounding bodies U1, U2 are guided to a sound path B2 formed at a bottom B1 of the housing B. Then, the constitution is such that multiple areas along the periphery of the vibration plate constituting the piezoelectric speaker U2 are supported by multiple pillars B3 formed at the bottom B1 of the housing B.

Also, while the aforementioned embodiments explain examples where the support member that supports the vibration plate of the piezoelectric speaker is constituted by a member independent of the housing, the support member may be constituted by a part of the housing. With the electroacoustic transducer 800 shown in FIG. 15, for example, the multiple pillars B3 are constituted as part of the housing B. The periphery of the vibration plate is joined to the top surface of each pillar B3 via adhesive agent or elastically deformable adhesive material, for example. In this case, each pillar B3 corresponds to, for example, each of the multiple projections 233 of the support member 23 as explained in the first embodiment.

Also with the electroacoustic transducer 800, a ring-shaped clearance is formed between the outer periphery of the piezoelectric speaker U2 and the side wall of the housing B. Accordingly, the low-pitch sound waves generated by the dynamic speaker U1 are guided to the sound path B2 through a passage T formed by the ring-shaped space between the piezoelectric speaker U2 and the side wall of the housing B and the space formed between the multiple pillars B3.

Figure 16:
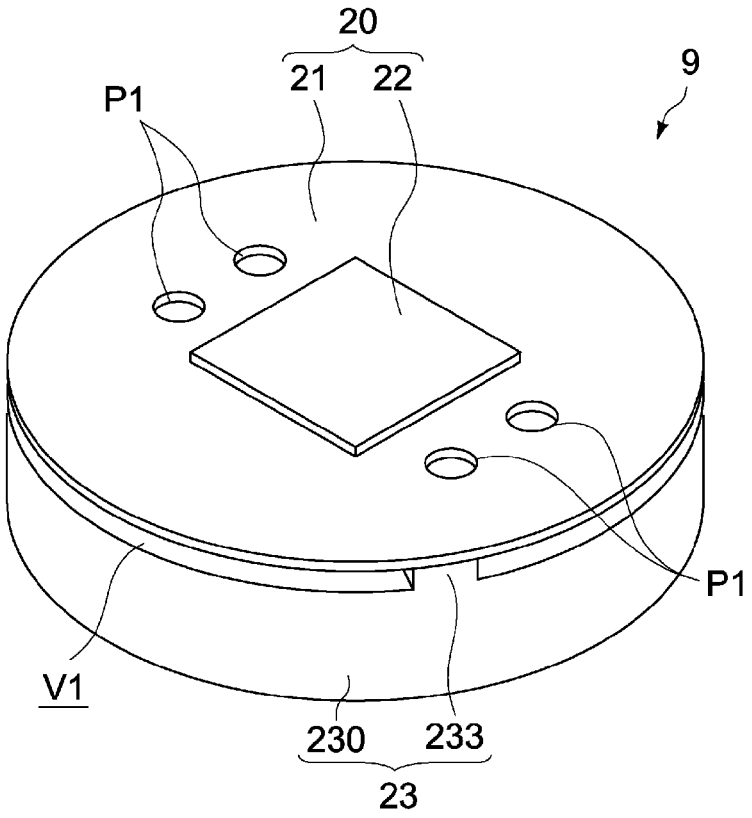
FIG. 16 is a general perspective view showing a constitutional variation example of the speaker unit shown in FIG. 3.

Furthermore, while the fifth embodiment (FIG. 14) explains a constitutional example where the passages P1 are formed at the vibration plate 21, the passages P1 may be provided in a similar manner at any of the vibration plates explained in the first through fourth embodiments. FIG. 16 is a perspective view of a speaker unit 9 illustrating an example of application to the first embodiment.

In FIG. 16, sound waves generated by the dynamic speaker pass through the multiple passages P1 constituted by through holes formed in the vibration plate 21. In this case, the void V1 formed between the multiple projections 233 supporting the periphery of the vibration plate 21 may also be caused to function as a passage for the sound waves mentioned above. Furthermore, although not illustrated, a cutout of specified shape may be formed along the periphery of the vibration plate in place of the passage P1 to constitute the passage. One or multiple cutouts may be provided and if there are multiple cutouts, the shape of each cutout may be the same or different.

The vibration plate on which cutouts are formed partially along the circular periphery is also included in the context of a "disk-shaped vibration plate." The cutout need not be formed only as the passage. In other words, the "disk-shaped vibration plate" can have a concave shape sinking in from its outer periphery toward the inner periphery, or cutouts formed as slits, etc., as necessary. It should be noted that even when the planar shape of the vibration plate is not strictly circular due to formation of the cutouts, etc., it is still considered "disk-shaped" so long as the shape is roughly circular.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2014-243807, filed Dec. 2, 2014, and 2015-066539, filed Mar. 27, 2015, each disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electroacoustic transducer comprising:

a housing;

a piezoelectric speaker that includes a planar vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which elastically supports only a periphery of the first surface or second surface with the supporting part, wherein the periphery of the first surface or second surface is fixed to the support part via an elastically deformable first adhesive layer which is constituted by double-sided adhesive tape.

2. An electroacoustic transducer according to claim 1, wherein the support member further has an annular body with a first end positioned on the vibration plate side and a second end on the opposite side of the first end, and the dynamic speaker is housed inside the annular body, wherein the elastically deformable first adhesive layer is provided between the periphery and the first end.

3. An electroacoustic transducer according to claim 2, wherein the support member is constituted by a member different from the housing, and the electroacoustic transducer further has an elastically deformable second adhesive layer provided between the support member and the housing.

4. An electroacoustic transducer according to claim 3, wherein the supporting part supports the vibration plate in multiple areas on the periphery.

5. An electroacoustic transducer according to claim 2, wherein the supporting part supports the vibration plate in multiple areas on the periphery.

6. An electroacoustic transducer according to claim 5, wherein the supporting part has multiple projections provided at the first end.

7. An electroacoustic transducer according to claim 2, further comprising a passage provided at the vibration plate to let sound waves generated by the dynamic speaker pass through.

8. An electroacoustic transducer according to claim 2, wherein the piezoelectric element has a structure where multiple piezoelectric layers and multiple electrode layers are alternately stacked together.

9. An electroacoustic transducer according to claim 1, further comprising a passage provided at the vibration plate to let sound waves generated by the dynamic speaker pass through.

10. An electroacoustic transducer according to claim 1, wherein the piezoelectric element has a structure where multiple piezoelectric layers and multiple electrode layers are alternately stacked together.

11. An electroacoustic transducer comprising:

a housing;

a piezoelectric speaker that includes a vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which supports a periphery of the first surface or second surface with the supporting part, wherein the support member further has an annular body with a first end positioned on the vibration plate side and a second end on the opposite side of the first end, and the dynamic speaker is housed inside the annular body, wherein the supporting part supports the vibration plate in multiple areas on the periphery, wherein the supporting part has multiple projections provided at the first end, wherein the annular body has roughly the same outer diameter as that of the vibration plate, and the multiple projections project from the first end in an axial direction of the annular body.

12. An electroacoustic transducer comprising:

a housing;

a piezoelectric speaker that includes a vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which supports a periphery of the first surface or second surface with the supporting part, wherein the support member further has an annular body with a first end positioned on the vibration plate side and a second end on the opposite side of the first end, and the dynamic speaker is housed inside the annular body, wherein the supporting part supports the vibration plate in multiple areas on the periphery, wherein the supporting part has multiple projections provided at the first end, wherein the annular body has an inner diameter equivalent to or greater than the outer diameter of the vibration plate, and the multiple projections project diametrically inward from the first end.

13. An electroacoustic transducer according to claim 12, wherein a void between the multiple projections is constituted as a passage to let sound generated by the dynamic speaker pass through.

14. An electroacoustic transducer comprising:

a housing;

a piezoelectric speaker that includes a vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which supports a periphery of the first surface or second surface with the supporting part, wherein the support member further has an annular body with a first end positioned on the vibration plate side and a second end on the opposite side of the first end, and the dynamic speaker is housed inside the annular body, wherein the supporting part supports the vibration plate in multiple areas on the periphery, wherein the supporting part has multiple projections provided at the first end, wherein a void between the multiple projections is constituted as a passage to let sound generated by the dynamic speaker pass through.

15. An electroacoustic transducer comprising:

a housing;

a piezoelectric speaker that includes a vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which supports a periphery of the first surface or second surface with the supporting part, wherein the support member further has an annular body with a first end positioned on the vibration plate side and a second end on the opposite side of the first end, and the dynamic speaker is housed inside the annular body, said electroacoustic transducer further comprising an elastically deformable first adhesive layer provided between the periphery and the first end, wherein the supporting part supports the vibration plate in multiple areas on the periphery, wherein a void between the multiple projections is constituted as a passage to let sound generated by the dynamic speaker pass through.

16. An electroacoustic transducer comprising:

a housing;

a piezoelectric speaker that includes a vibration plate with a first surface and a second surface on the opposite side of the first surface, and a piezoelectric element joined to at least one of the first surface and second surface, and which divides an interior of the housing into a first space facing the first surface and a second space facing the second surface;

a dynamic speaker placed in the first space; and a support member which is constituted by a part of the housing or by a member different from the housing, and which has a supporting part facing the first surface or second surface, and which supports a periphery of the first surface or second surface with the supporting part, wherein the support member further has an annular body with a first end positioned on the vibration plate side and a second end on the opposite side of the first end, and the dynamic speaker is housed inside the annular body, wherein the supporting part supports the vibration plate in multiple areas on the periphery, wherein the multiple areas include multiple projecting pieces that project radially toward a perimeter of the vibration plate.

17. An electroacoustic transducer according to claim 16, wherein a void between the multiple projecting pieces is constituted as a passage to let sound generated by the dynamic speaker pass through.

* * * * *